US011261780B2

(12) United States Patent
Oso et al.

(10) Patent No.: US 11,261,780 B2
(45) Date of Patent: Mar. 1, 2022

(54) ENGINE EQUIPPED WITH SUPERCHARGER

(71) Applicant: KUBOTA Corporation, Osaka (JP)

(72) Inventors: Hiroki Oso, Sakai (JP); Nobuyoshi Okada, Sakai (JP); Shingo Matsunobu, Sakai (JP); Yoshinori Tanaka, Sakai (JP); Ayako Sakurai, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 256 days.

(21) Appl. No.: 16/659,628

(22) Filed: Oct. 22, 2019

(65) Prior Publication Data

US 2020/0132122 A1 Apr. 30, 2020

(30) Foreign Application Priority Data

Oct. 31, 2018 (JP) ..... JP2018-205682

(51) Int. Cl.
*F01P 3/12* (2006.01)
*F01P 11/08* (2006.01)
(Continued)

(52) U.S. Cl.
CPC ..... *F02B 39/14* (2013.01); *F01P 3/02* (2013.01); *F01P 3/12* (2013.01); *F01P 11/08* (2013.01);
(Continued)

(58) Field of Classification Search
CPC ..... F01P 3/12; F01P 11/08; F01P 2003/008; F01P 2060/04; F02B 39/005; F02B 39/14; F02B 2039/164; F02M 35/10157
(Continued)

(56) References Cited

U.S. PATENT DOCUMENTS 6,125,799 A * 10/2000 Van Son ..... F02B 75/22 123/41.31
10,927,745 B1 * 2/2021 Langenfeld ..... B63H 21/14
(Continued)

FOREIGN PATENT DOCUMENTS

DE 102015109137 A1 12/2015
JP S52137249 U 10/1977
(Continued)

OTHER PUBLICATIONS

Extended European Search Report dated Mar. 17, 2020 in European Application No. 19202467.7.
(Continued)

*Primary Examiner* — Erick R Solis
(74) *Attorney, Agent, or Firm* — Panitch Schwarze Belisario & Nadel LLP

(57) ABSTRACT

There is provided an engine equipped with a supercharger that suppresses heat deterioration of engine oil. The engine equipped with a supercharger includes a supercharger; an oil supply passage that supplies engine oil to a shaft bearing part of the supercharger; an oil discharge passage that discharges the engine oil from the shaft bearing part of the supercharger; and a water-cooling-type oil cooler. The water-cooling-type oil cooler is provided in the oil discharge passage, and the engine oil discharged from the shaft bearing part of the supercharger is cooled by the engine cooling water that passes the water-cooling-type oil cooler. The engine cooling water is desirably supplied from the cylinder jacket to the water-cooling-type oil cooler.

7 Claims, 7 Drawing Sheets

(51) Int. Cl.

| | |
|---|---|
| ***F02B 39/14*** | (2006.01) |
| ***F02D 41/00*** | (2006.01) |
| ***F01P 3/02*** | (2006.01) |
| ***F02B 39/00*** | (2006.01) |
| *F02M 35/10* | (2006.01) |
| *F01P 3/00* | (2006.01) |
| *F02B 39/16* | (2006.01) |

(52) U.S. Cl.
CPC ..... *F02B 39/005* (2013.01); *F02D 41/0007* (2013.01); *F01P 2003/008* (2013.01); *F01P 2060/04* (2013.01); *F02B 2039/164* (2013.01); *F02M 35/10157* (2013.01)

(58) Field of Classification Search
USPC ..... 123/41.33, 196 AB, 563
See application file for complete search history.

(56) References Cited

U.S. PATENT DOCUMENTS

| | | | | |
|---|---|---|---|---|
| 2006/0207543 | A1* | 9/2006 | Rehr | F01M 5/002 123/196 AB |
| 2015/0361839 | A1* | 12/2015 | Kimura | F01M 13/04 123/196 A |
| 2017/0114699 | A1* | 4/2017 | Okita | F02B 39/005 |

FOREIGN PATENT DOCUMENTS

| | | | |
|---|---|---|---|
| JP | H07280468 | A | 10/1995 |
| JP | H09151718 | A | 6/1997 |
| JP | 2000199415 | A | 7/2000 |
| JP | 2016000963 | A | 1/2016 |

OTHER PUBLICATIONS

Office Action issued Dec. 8, 2021 in Japanese Application No. 2018-205682.

* cited by examiner

ENGINE EQUIPPED WITH SUPERCHARGER

CROSS-REFERENCE TO RELATED APPLICATION

This application claims priority under 35 U.S.C. § 119(b) to Japanese Application No. 2018-205682, filed Oct. 31, 2018, the disclosure of which is incorporated by reference herein in its entirety.

BACKGROUND OF THE INVENTION

(1) Field of the Invention

The present invention relates to an engine equipped with a supercharger.

(2) Description of Related Art

In a conventional engine equipped with a supercharger, there is no means for efficiently cooling engine oil, and therefore engine oil is excessively heated by heat generated by a shaft bearing part of a supercharger, and heat deterioration of the engine oil easily occurs.

An object of the present invention is to provide an engine equipped with a supercharger that suppresses heat deterioration of engine oil.

In the present invention, an oil discharge passage for discharging engine oil from a shaft bearing part of a supercharger is provided, and a water-cooling-type oil cooler is provided in the oil discharge passage.

According to the present invention, heat deterioration of engine oil is suppressed.

BRIEF DESCRIPTION OF THE DRAWINGS

FIG. 1B is an enlarged cross-sectional view taken along line B-B of FIG. 1A;

FIG. 2A is a side view, and FIG. 2B is a front view;

FIG. 3A is a side view, and FIG. 3B is a back view;

DETAILED DESCRIPTION OF PREFERRED EMBODIMENTS

FIGS. 1 through 7 are views for explaining an engine equipped with a supercharger according to an embodiment of the present invention. In this embodiment, a water-cooled vertical in-line multi-cylinder diesel engine is described.

Figure 5:
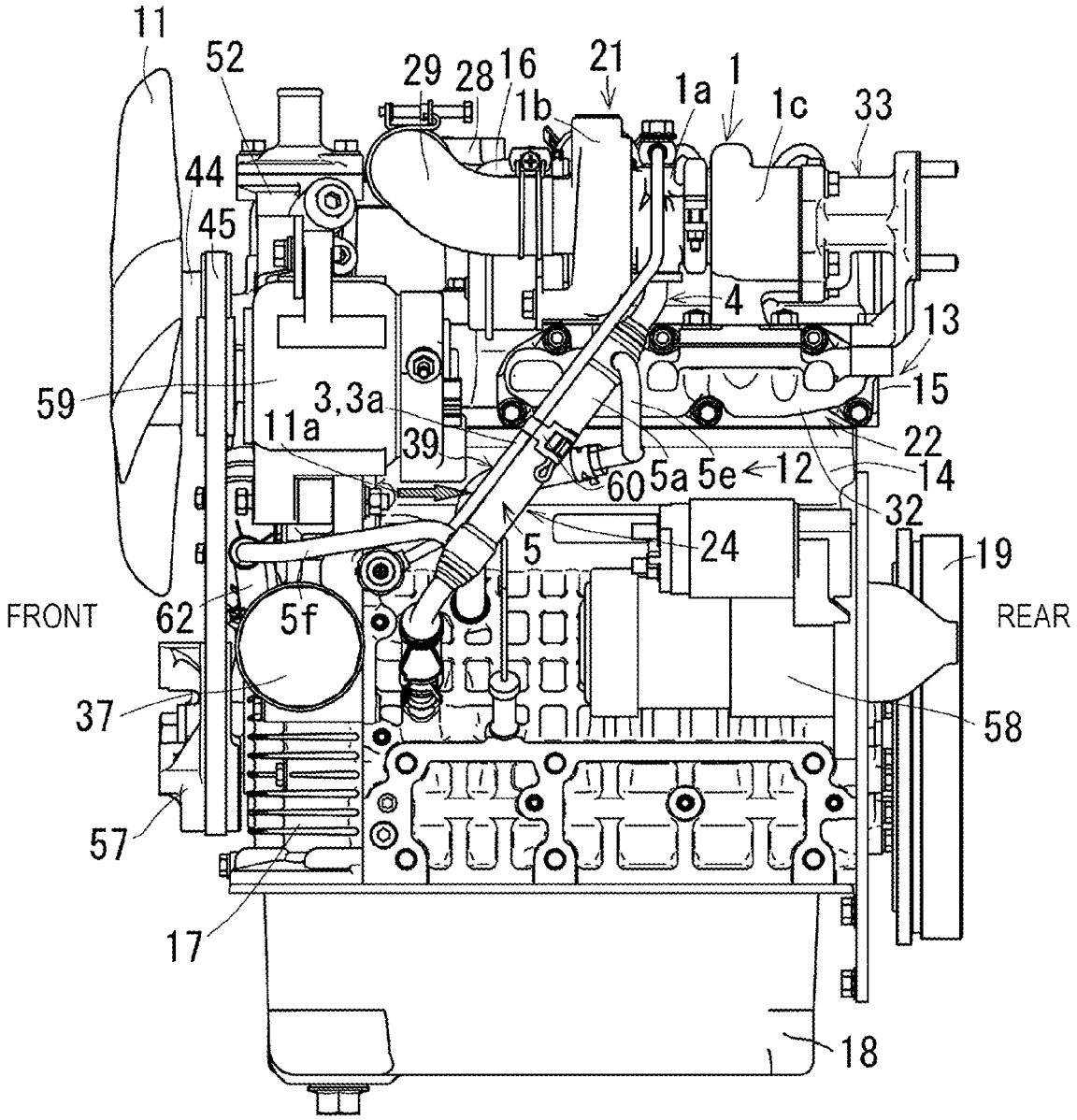
FIG. 5 is a side view of the engine of FIGS. 1A and 1B.
Figure 6:
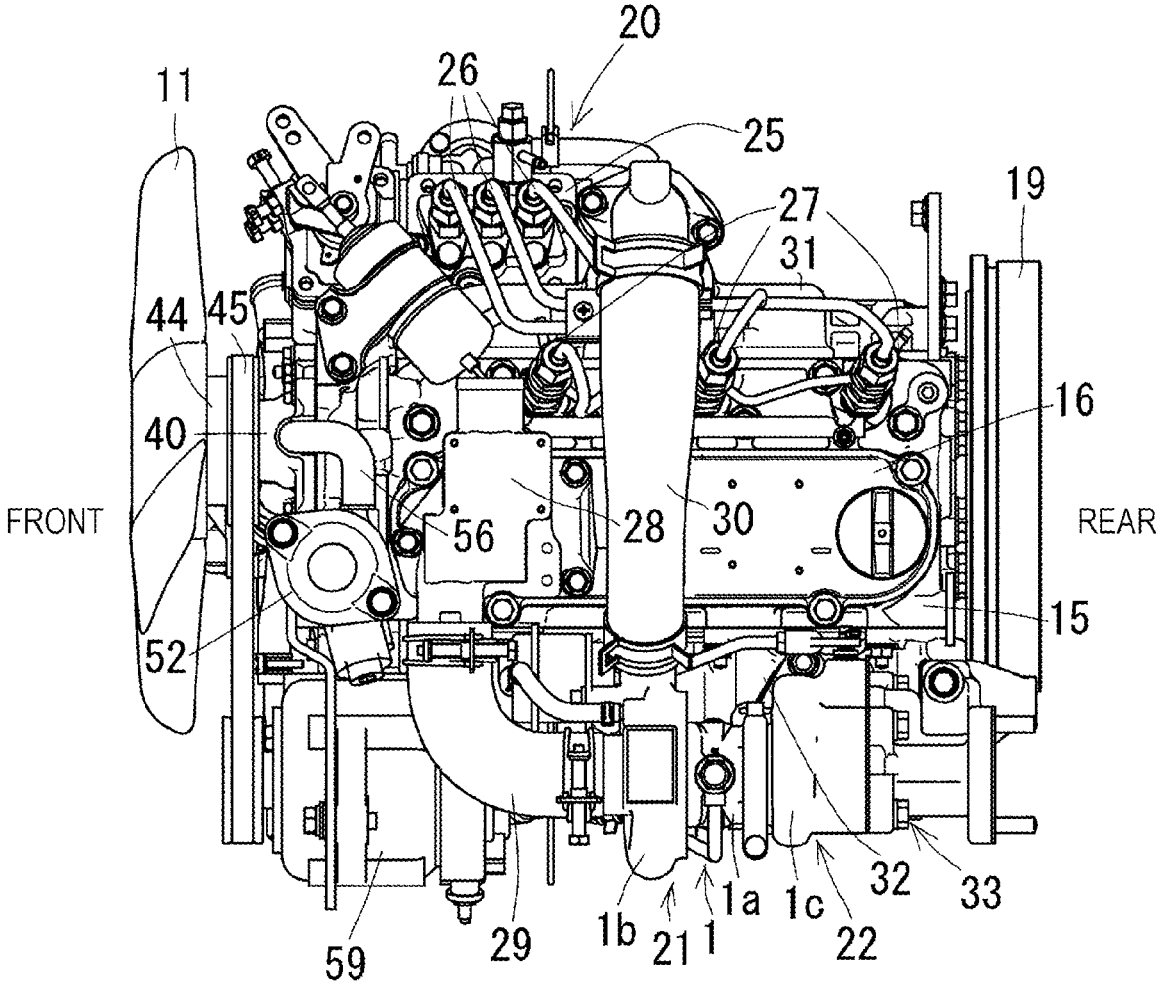
FIG. 6 is a plan view of the engine of FIGS. 1A and 1B.
Figure 7:
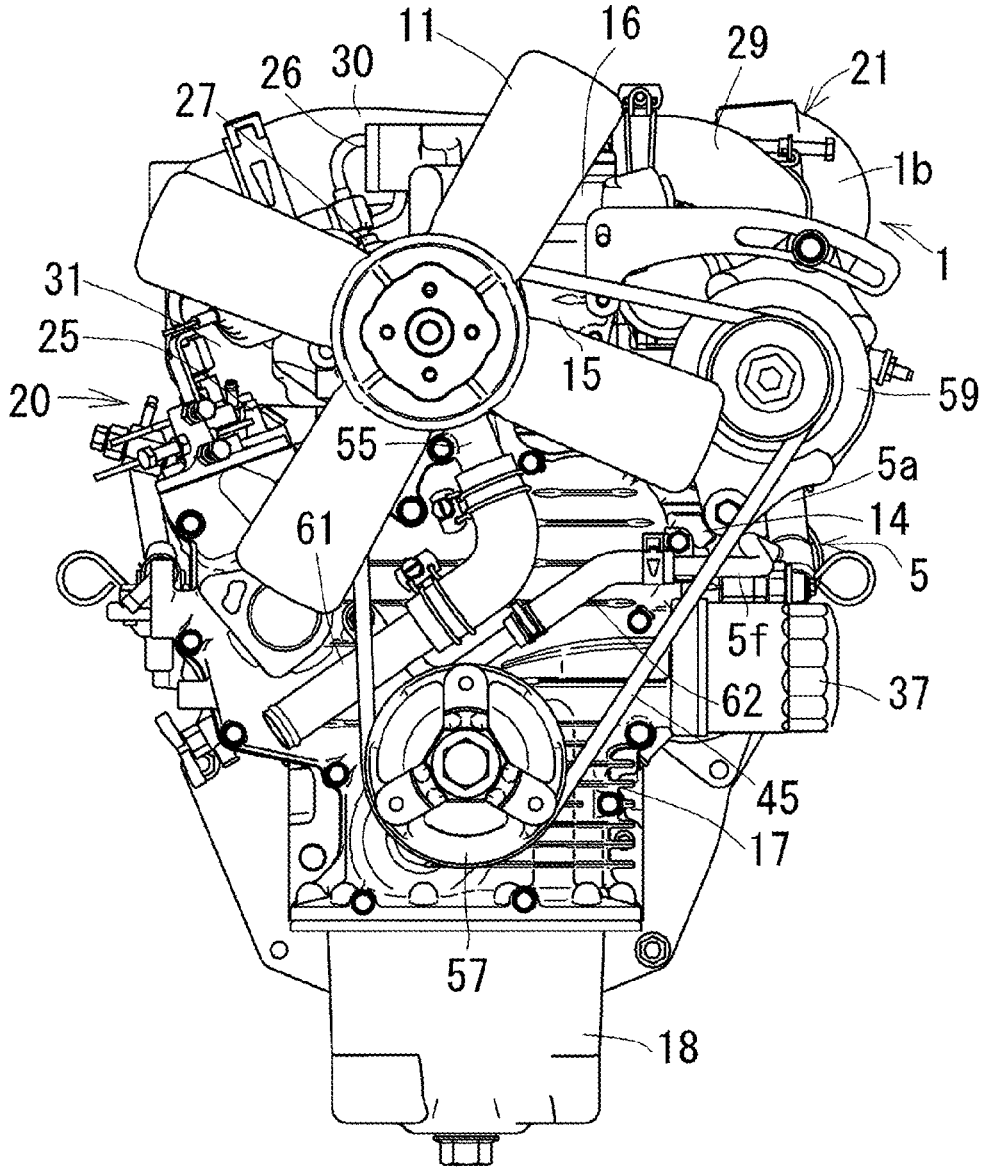
FIG. 7 is a front view of the engine of FIGS. 1A and 1B.

As illustrated in FIGS. 5 through 7, this engine includes a cylinder block (14), a cylinder head (15) fastened to an upper part of the cylinder block (14), a cylinder head cover (16) fastened to an upper part of the cylinder head (15), a front cover (17) fastened to a front part of the cylinder block (14), an engine cooling fan (11) disposed on a front part of the cylinder head (15), an oil pan (18) fastened to a lower part of the cylinder block (14), and a flywheel (19) disposed on a rear part of the cylinder block (14). In FIG. 5, a starter (58) is illustrated.

This engine is described assuming that a direction in which a crank shaft (not illustrated) extends is a front-rear direction, an engine cooling fan (11) side is a front side, a flywheel (19) side is a rear side, and a horizontal direction orthogonal to the front-rear direction is a lateral direction.

This engine includes a fuel supplying device (20), an air intake device (21), and an air exhaust device (22) of FIG. 6 and an engine water-cooling device (7), a lubricating device (23), and an oil cooling device (24) of FIG. 1.

The fuel supplying device (20) of FIG. 6 is a device that supplies fuel to a combustion chamber (not illustrated) and includes a fuel injection pump (25), a fuel injection tube (26) that is connected to the fuel injection pump (25), and a fuel injector (27) that is connected to the fuel injection tube (26).

The air intake device (21) of FIG. 6 is a device that supplies air to the combustion chamber and includes an air cleaner (not illustrated), a first air intake pipe (not illustrated) that is connected to the air cleaner, a blow-by gas supply chamber (28) that is connected to the first air intake pipe, a second air intake pipe (29) that is connected to the blow-by gas supply chamber (28), an air compressor (1*b*) of the supercharger (1) that is connected to the second air intake pipe (29), a supercharging pipe (30) that is connected to the air compressor (1*b*), and an air intake manifold (31) that is connected to the supercharging pipe (30).

The blow-by gas supply chamber (28) is a chamber for causing blow-by gas to flow back to air intake from a breather chamber (not illustrated) in the cylinder head cover (16) and is provided on a ceiling part of the cylinder head cover (16).

The supercharger (1) of FIG. 6 is a device for supercharging the air intake manifold (31) and includes an air exhaust turbine (1*c*) that is connected to an air exhaust manifold (32), an air compressor (1*b*), and a shaft bearing part (1*a*) of a turbine shaft (not illustrated) located between the air exhaust turbine (1*c*) and the air compressor (1*b*).

The air exhaust device (22) of FIG. 6 is a device that discharges exhaust air of the combustion chamber and includes the air exhaust manifold (32) and an air exhaust lead-out path (33) that follows the air exhaust manifold (32) and includes the air exhaust turbine (1*c*), an air exhaust muffler (not illustrated), and the like of the supercharger (1).

Figure 1A:
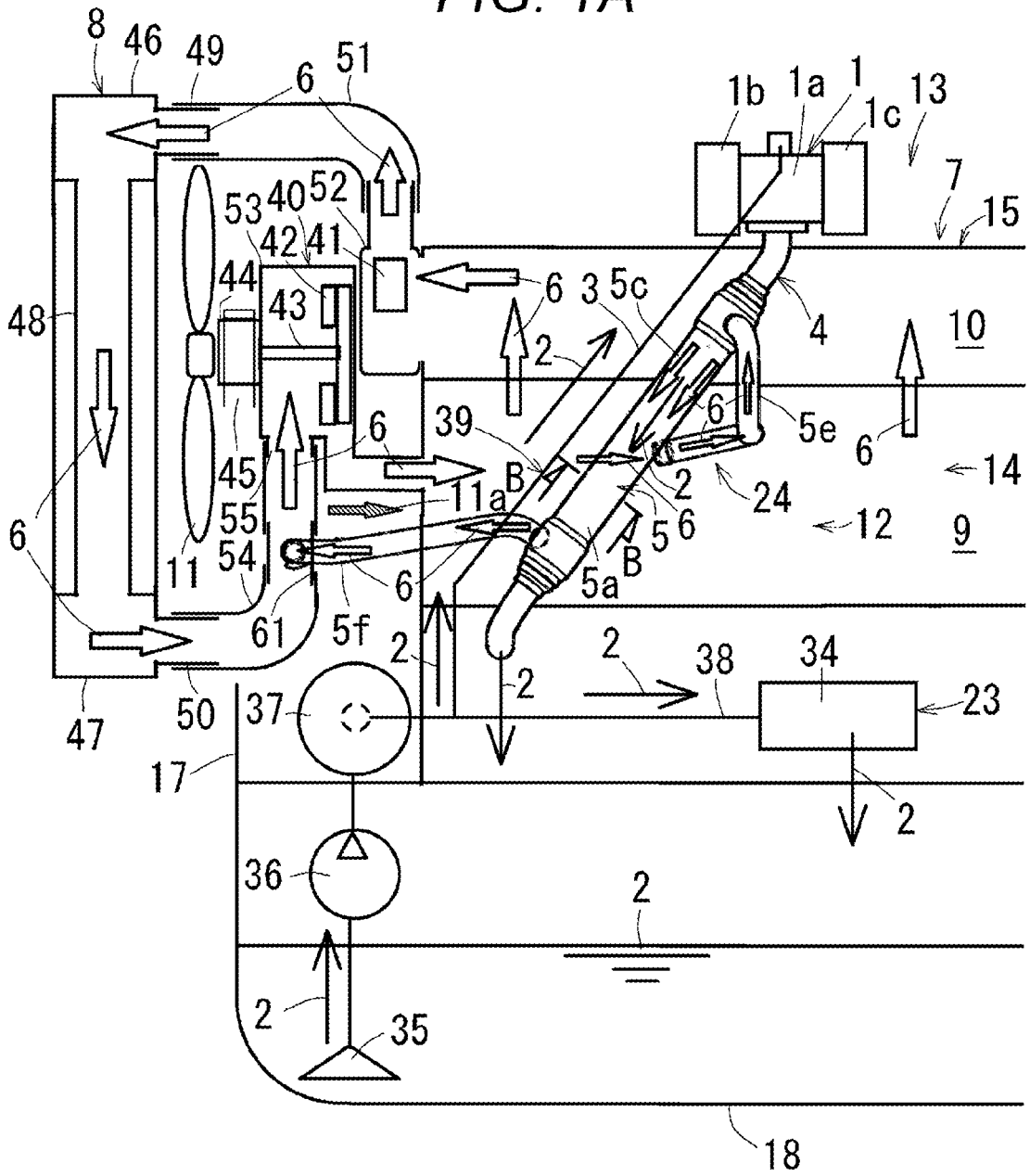
FIGS. 1A and 1B are views for explaining a substantial part of an engine equipped with a supercharger according to an embodiment of the present invention, FIG. 1A schematically illustrates a side surface.

The lubricating device (23) of FIG. 1A is a device that lubricates an engine sliding part (34) such as a shaft bearing of the crank shaft and includes the oil pan (18), an oil strainer (35) immersed in engine oil (2) accumulated in the oil pan (18), an oil pump (36), an oil filter (37), an oil gallery (38) that supplies the engine oil (2) purified by the oil filter (37) to the engine sliding part (34), and a shaft bearing lubricating passage (39) that lubricates the shaft bearing part (1*a*) of the supercharger (1).

The shaft bearing lubricating passage (39) of FIG. 1A includes an oil supply passage (3) that supplies the engine oil (2) to the shaft bearing part (1*a*) of the turbine shaft of the supercharger (1) and an oil discharge passage (4) that discharges the engine oil (2) from the shaft bearing part (1*a*).

The oil supply passage (3) is a passage branching from the oil gallery (38), and an end of the oil supply passage (3) is connected to an upper part of the shaft bearing part (1*a*) of the supercharger (1).

The oil discharge passage (4) is led out from a lower part of the shaft bearing part (1*a*) of the supercharger (1), an end of the oil discharge passage (4) is connected to the cylinder block (14), and the engine oil (2) discharged from the shaft bearing part (1*a*) of the supercharger (1) returns to the oil pan (18) through the oil discharge passage (4).

The engine water-cooling device (7) of FIG. 1A is a device that water-cools an engine and includes a radiator (8) that releases heat of engine cooling water (6), a cooling-water pump (40) that sucks the engine cooling water (6) whose heat has been released by the radiator (8) and feeds the engine cooling water (6) to a cylinder jacket (9) by pressure, the cylinder jacket (9), a cylinder head jacket (10) that is communicated with the cylinder jacket (9), a water flange (52) that includes a thermostat valve (41) that controls reflux of the engine cooling water (6) from the cylinder head jacket (10) to the radiator (8) and stoppage of the reflux, and a return pipe (56) of FIG. 6 that causes the engine cooling water (6) of the cylinder head jacket (10) to flow back to the cooling-water pump (40) from the water flange (52).

In the engine water-cooling device (7) of FIG. 1A, a whole amount of the engine cooling water (6) is sucked from the return pipe (56) of FIG. 6 into the cooling-water pump (40) by closing of the thermostat valve (41), bypasses the radiator (8), circulates through the cooling-water pump (40), the cylinder jacket (9), and the cylinder head jacket (10) in this order, and warms the engine while a temperature of the engine cooling water (6) is relatively low.

When the temperature of the engine cooling water (6) becomes high, the engine cooling water (6) circulates through the radiator (8), the cooling-water pump (40), the cylinder jacket (9), and the cylinder head jacket (10) by opening of the thermostat valve (41) and thus cools the engine. Part of the engine cooling water (6) is sucked from the return pipe (56) of FIG. 6 into the cooling-water pump (40) and bypasses the radiator (8).

The cooling-water pump (40) of FIG. 1A is disposed ahead of the cylinder head (15) and includes a water pump case (53), an impeller (42) contained in the water pump case (53), and an input shaft (43) of the impeller (42).

An input pulley (44) attached to the input shaft (43) and the engine cooling fan (11) attached to the input pulley (44) are disposed ahead of the water pump case (53). The input pulley (44) is linked to a crank pulley (57) of FIGS. 5 and 7 through a fan belt (45), and the impeller (42) and the engine cooling fan (11) are driven by the crank pulley (57) through the fan belt (45). In FIGS. 3A and 4 through 7, an alternator (59) that also serves as a belt tensioner is illustrated. A generator may be used instead of the alternator.

The radiator (8) of FIG. 1A is disposed ahead of the engine cooling fan (11) and includes an upper tank (46), a lower tank (47), a heat release tube (48) provided between the upper tank (46) and the lower tank (47), a cooling-water inlet (49) that introduces the engine cooling water (6) into the upper tank (46), and a cooling-water outlet (50) that leads the engine cooling water (6) out from the lower tank (47).

The cooling-water inlet (49) of the radiator (8) is connected to the water flange (52) through a cooling-water introducing hose (51), and the cooling-water outlet (50) of the radiator (8) is connected to a pump inlet (55) of the cooling-water pump (40) through a cooling-water lead-out hose (54).

The cylinder jacket (9) of FIG. 1A is provided in the cylinder block (14), and a cylinder (not illustrated) and a piston (not illustrated) in the cylinder are cooled by the engine cooling water (6) that passes the cylinder jacket (9).

The cylinder head jacket (10) is provided in the cylinder head (15), and the cylinder head (15) is cooled by the engine cooling water (6) that passes the cylinder head jacket (10).

The oil cooling device (24) of FIG. 1A is a device that cools the engine oil (2) and includes a water-cooling-type oil cooler (5), the water-cooling-type oil cooler (5) is provided in the oil discharge passage (4), and the engine oil (2) discharged from the shaft bearing part (1*a*) of the supercharger (1) is cooled by the engine cooling water (6) that passes the water-cooling-type oil cooler (5).

With this configuration, high-temperature engine oil (2) discharged from the shaft bearing part (1*a*) of the supercharger (1) into the oil discharge passage (4) exchanges heat with the engine cooling water (6) having a large temperature difference from the engine oil (2) in the water-cooling-type oil cooler (5). Since cooling efficiency of the engine oil (2) is high, heat deterioration of the engine oil (2) is suppressed.

The water-cooling-type oil cooler (5) has a straight cylindrical shape and is disposed so as to be inclined downward toward a front side beside the cylinder block (14).

As illustrated in FIG. 1A, the engine cooling water (6) is supplied from the cylinder jacket (9) to the water-cooling-type oil cooler (5).

With this configuration, the engine cooling water (6) having a relatively low temperature that has not been supplied to the cylinder head jacket (10) yet is supplied from the cylinder jacket (9) to the water-cooling-type oil cooler (5) after releasing heat in the radiator (8). Since a temperature difference between the engine oil (2) heat-exchanged in the water-cooling-type oil cooler (5) and the engine cooling water (6) is large, cooling efficiency of the engine oil (2) is high.

Figure 1B:
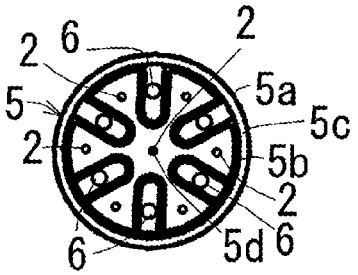

As illustrated in FIG. 1B, the water-cooling-type oil cooler (5) is constituted by an outer cylinder (5*a*) and an inner cylinder (5*b*), the engine oil (2) passes through the inner cylinder (5*b*), the engine cooling water (6) passes through a cooler jacket (5*c*) between the inner cylinder (5*b*) and the outer cylinder (5*a*), and heat of the engine oil (2) in the inner cylinder (5*b*) is released to the engine cooling water (6) in the cooler jacket (5*c*) through a circumferential wall of the inner cylinder (5*b*).

With this configuration, the engine oil (2) is easily and efficiently cooled by the water-cooling-type oil cooler (5) having a simple structure constituted by the outer cylinder (5*a*) and the inner cylinder (5*b*).

Since the engine oil (2) that passes through the inner cylinder (5*b*) is cooled by the surrounding engine cooling water (6), cooling efficiency of the engine oil (2) is high.

The engine oil (2) that passes through the inner cylinder (5*b*) is cooled by the engine cooling water (6) that is less affected by a change in outside air temperature than a case where the engine oil (2) is cooled by air cooling using surrounding engine cooling air (11*a*). This stabilizes the temperature of the engine oil (2).

A place where the engine oil (2) and the engine cooling water (6) in the water-cooling-type oil cooler (5) may be changed.

That is, it is also possible to employ a configuration in which the water-cooling-type oil cooler (5) is constituted by the outer cylinder (5*a*) and the inner cylinder (5*b*), the engine cooling water (6) passes through the inner cylinder (5*b*), the engine oil (2) passes through the cooler jacket (5*c*) between the inner cylinder (5*b*) and the outer cylinder (5*a*), and heat of the engine oil (2) in the cooler jacket (5*c*) is released to the engine cooling water (6) in the inner cylinder (5*b*) through a circumferential wall of the inner cylinder (5*b*).

Also in this case, the engine oil (2) is easily and efficiently cooled by the water-cooling-type oil cooler (5) having a simple structure constituted by the outer cylinder (5*a*) and the inner cylinder (5*b*).

As illustrated in FIGS. 1A and 1B, the engine cooling water (6) that passes through the water-cooling-type oil cooler (5) is supplied to the water-cooling-type oil cooler (5) on an upstream side in an oil passing direction that is a direction in which the engine oil (2) passes through the water-cooling-type oil cooler (5) and is discharged from the water-cooling-type oil cooler (5) on a downstream side in the oil passing direction.

With this configuration, on the upstream side in the oil passing direction of the water-cooling-type oil cooler (5), the high-temperature engine oil (2) immediately after being supplied to the water-cooling-type oil cooler (5) is cooled by the low-temperature engine cooling water (6) immediately after being supplied to the water-cooling-type oil cooler (5). Since a temperature difference between the engine oil (2) and the engine cooling water (6) that exchange heat in the water-cooling-type oil cooler (5) is large, cooling efficiency of the engine oil (2) is high.

The water-cooling-type oil cooler (5) may be counter-current type instead of the above co-current type.

Although the counter-current type is not illustrated, the counter-current type is described below by using the component names and reference signs of the co-current type of FIG. 1A. In the counter-current type, the engine cooling water (6) that passes through the water-cooling-type oil cooler (5) is supplied to the water-cooling-type oil cooler (5) on a downstream side in an oil passing direction that is a direction in which the engine oil (2) passes through the water-cooling-type oil cooler (5) and is discharged from the water-cooling-type oil cooler (5) on an upstream side in the oil passing direction.

In the counter-current type, a flow of the engine cooling water (6) and the engine oil (2) that pass through the water-cooling-type oil cooler (5) is counter-current, and a logarithmic mean temperature difference is larger, an amount of heat exchange is larger, and cooling efficiency of the engine oil (2) is higher than the co-current type.

As illustrated in FIG. 1A, the engine cooling fan (11) is provided, the outer cylinder (5*a*) of the water-cooling-type oil cooler (5) is made of a metal, and an outer circumferential surface of the outer cylinder (5*a*) is exposed to the engine cooling air (11*a*) in an air path (12) for the engine cooling air (11*a*) generated by the engine cooling fan (11).

With this configuration, in a case where the engine cooling water (6) passes through the cooler jacket (5*c*) of the water-cooling-type oil cooler (5), the engine cooling water (6) that has reached a high temperature by receiving heat released from the high-temperature engine oil (2) through heat exchange in the water-cooling-type oil cooler (5) is air-cooled by the engine cooling air (11*a*) during passage through the cooler jacket (5*c*). This suppresses a rise in temperature of the engine cooling water (6) that returns from the water-cooling-type oil cooler (5) to an engine body (13), thereby suppressing insufficiency of engine cooling.

Meanwhile, in a case where the engine oil (2) passes through the cooler jacket (5*c*) of the water-cooling-type oil cooler (5), the high-temperature engine oil (2) is air-cooled by the engine cooling air (11*a*) while passing through the cooler jacket (5*c*), heat release from the engine oil (2) to the engine cooling water (6) that passes through the inner cylinder (5*b*) of the water-cooling-type oil cooler (5) is suppressed, a rise in temperature of the engine cooling water (6) that returns from the water-cooling-type oil cooler (5) to the engine body (13) is suppressed, and insufficiency of engine cooling is suppressed.

The engine body (13) is a body part of the engine excluding engine auxiliaries such as the water-cooling-type oil cooler (5) and is a part including members such as the cylinder block (14) and the cylinder head (15).

The engine cooling air (11*a*) generated by the engine cooling fan (11) illustrated in FIG. 7 passes backward beside the cylinder block (14) as illustrated in FIG. 5 after passing a gap between the front cover (17) and the alternator (59) and a gap between the alternator (59) and the oil filter (37). This forms the air path (12) for the engine cooling air (11*a*) beside the cylinder block (14).

As illustrated in FIG. 1A, the water-cooling-type oil cooler (5) includes a cooling-water introducing pipe (5*e*) for introducing the engine cooling water (6), the cooling-water introducing pipe (5*e*) is made of a metal, and an outer circumferential surface of the cooling-water introducing pipe (5*e*) is exposed to the engine cooling air (11*a*) in the air path (12).

With this configuration, the engine cooling water (6) immediately before being introduced into the water-cooling-type oil cooler (5) is air-cooled by the engine cooling air (11*a*). Since a temperature difference between the engine oil (2) and the engine cooling water (6) that exchange heat in the water-cooling-type oil cooler (5) is large, cooling efficiency of the engine oil (2) is high.

Figure 2B:
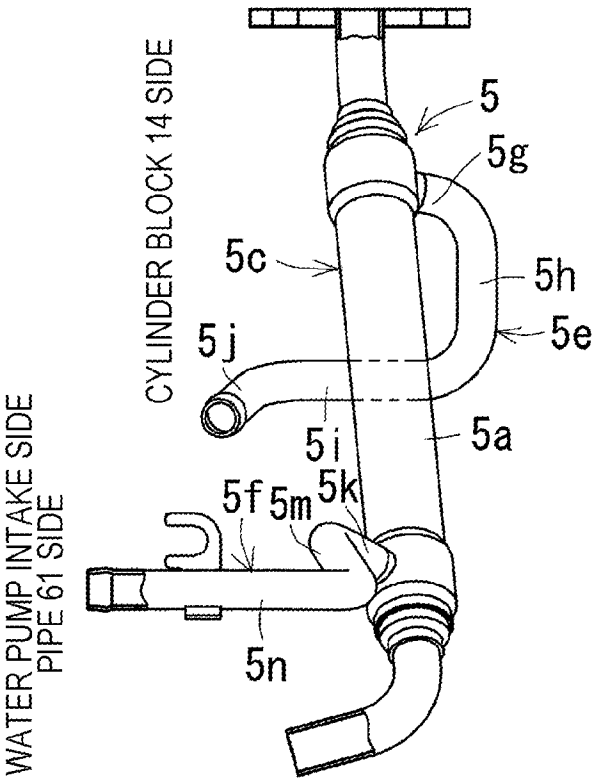
FIGS. 2A and 2B are views for explaining a water-cooling-type oil cooler used in the engine of FIGS. 1A and 1B.
Figure 2A:
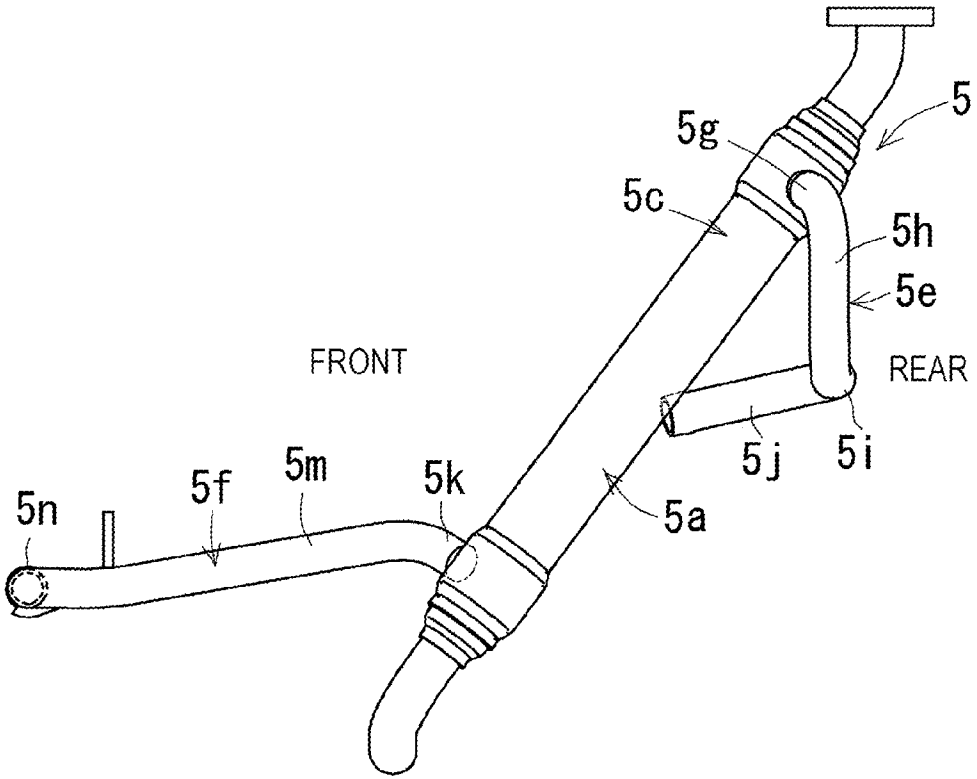

As illustrated in FIGS. 2A and 2B, the cooling-water introducing pipe (5*e*) includes an introduction-side obliquely downward part (5*g*) that is led out obliquely downward from a lateral side opposite to the cylinder block (14) side in the upper part of the cooler jacket (5*c*), an introduction-side vertically downward part (5*h*) that is bent vertically downward from the introduction-side obliquely downward part (5*g*), an introduction-side horizontal part (5*i*) that is bent horizontally from the introduction-side vertically downward part (5*h*) toward the cylinder block (14) side, and an introduction-side forward part (5*j*) that is bent forward from the introduction-side horizontal part (5*i*). As illustrated in FIG. 2A, the introduction-side vertically downward part (5*h*) and the introduction-side horizontal part (5*i*) are disposed on a rear side of the cooler jacket (5*c*), and as illustrated in FIG. 2B, the introduction-side horizontal part (5*i*) crosses the cooler jacket (5*c*) on a front view.

Figure 3B:
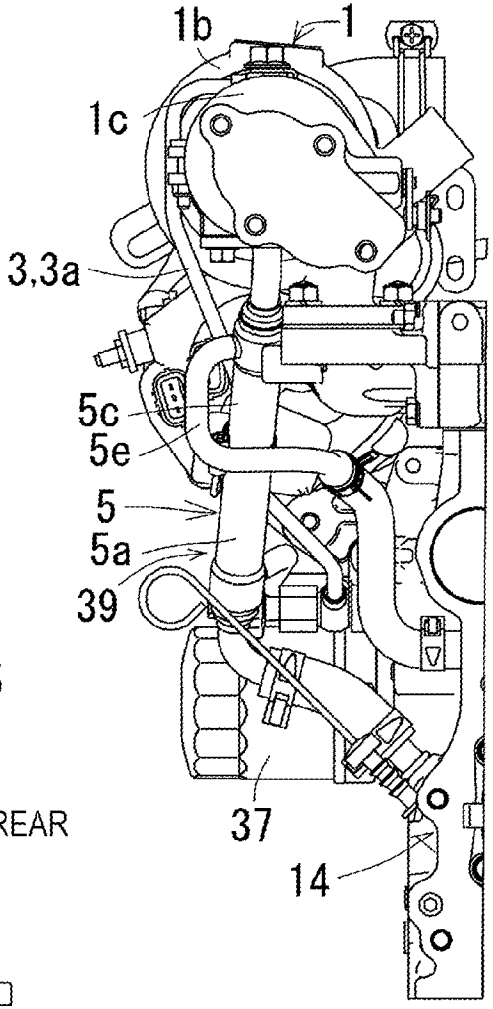
FIGS. 3A and 3B are views for explaining the water-cooling-type oil cooler of FIG. 2 and a surrounding part thereof.
Figure 3A:
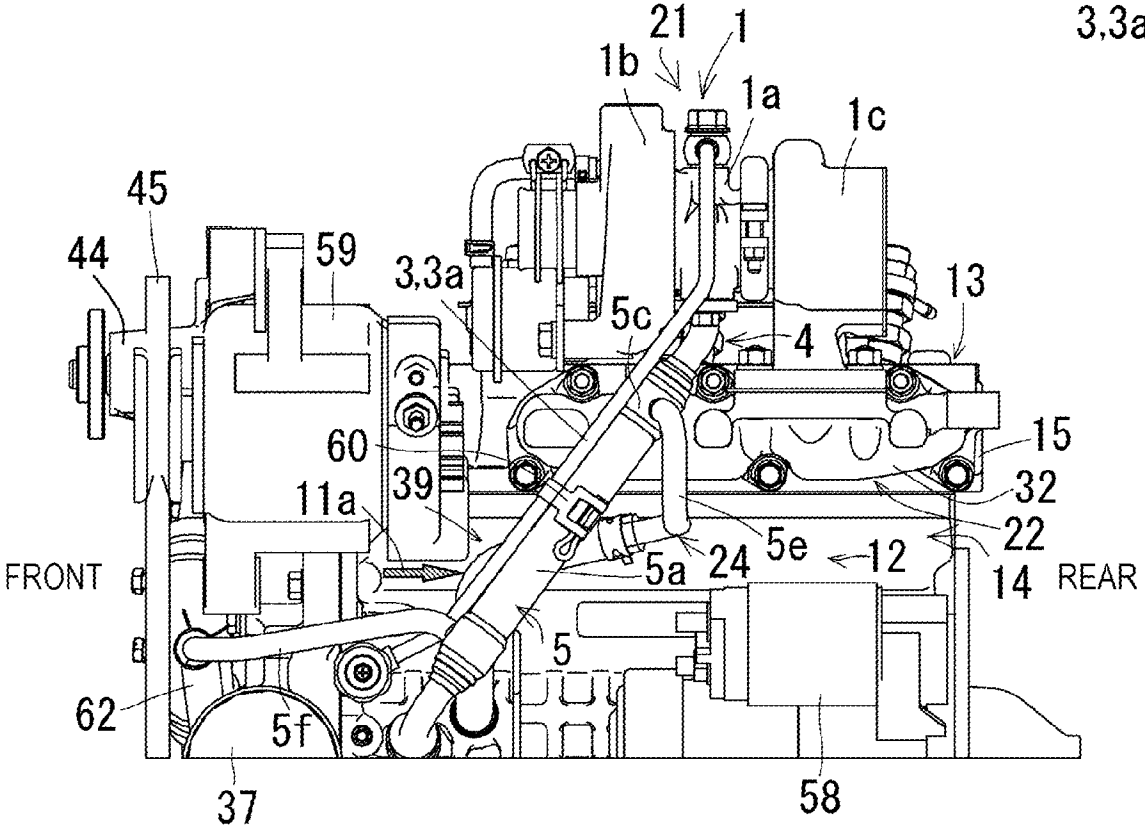
Figure 4:
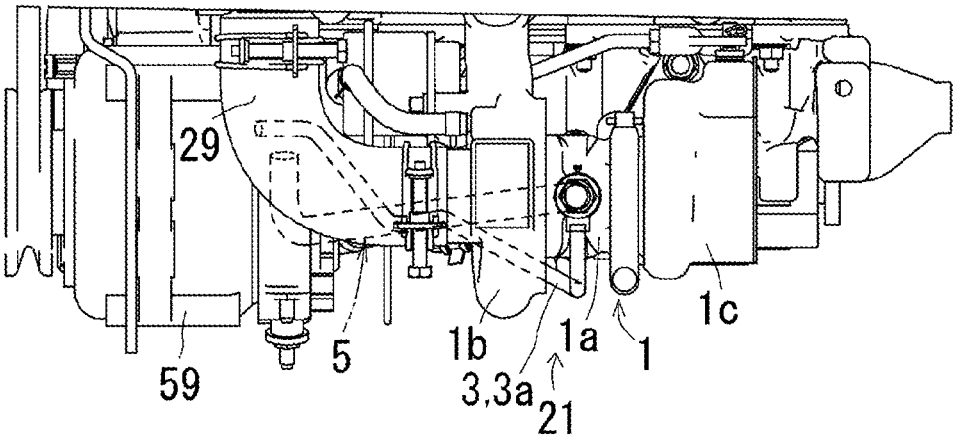
FIG. 4 is a plan view of FIG. 3.

As illustrated in FIGS. 2A and 2B, a cooling-water lead-out pipe (5*f*) includes a lead-out side obliquely upward part (5*k*) that is led out obliquely upward from a lateral side on the cylinder block (14) side in a lower part of the cooler jacket (5*c*), a lead-out side forward obliquely downward part (5*m*) that is bent obliquely downward toward the front side from the lead-out side obliquely upward part (5*k*), and a lead-out side horizontal part (5*n*) that is bent horizontally from the lead-out side forward obliquely downward part (5*m*) toward the water pump intake side pipe (61) side of FIG. 7, and the lead-out side horizontal part (5*n*) is communicated with the water pump intake side pipe (61) of FIGS. 1A and 7 through a relay rubber pipe (62) of FIGS. 3A, 5, and 7. As illustrated in FIG. 1A, the water pump intake side pipe (61) is disposed between the radiator (8) and the cooling-water pump (40).

As illustrated in FIG. 1A, the water-cooling-type oil cooler (5) includes the cooling-water lead-out pipe (5*f*) for leading out the engine cooling water (6), the cooling-water lead-out pipe (5*f*) is made of a metal, and an outer circumferential surface of the cooling-water lead-out pipe (5*f*) is exposed to the engine cooling air (11*a*) in the air path (12).

With this configuration, the engine cooling water (6) that has reached a high temperature by receiving heat released from the high-temperature engine oil (2) through heat exchange in the water-cooling-type oil cooler (5) is air-cooled by the engine cooling air (11*a*) after passing the water-cooling-type oil cooler (5). This suppresses a rise in temperature of the engine cooling water (6) that returns from the water-cooling-type oil cooler (5) to the engine body (13), thereby suppressing insufficiency of engine cooling.

As illustrated in FIGS. 3A and 5, the oil supply passage (3) is constituted by an oil supply pipe (3*a*) made of a metal, and an outer circumferential surface of the oil supply passage (3) is exposed to the engine cooling air (11*a*) in the air path (12).

With this configuration, the engine oil (2) immediately before being introduced into the shaft bearing part (1*a*) of the supercharger (1) is air-cooled by the engine cooling air (11*a*), and therefore cooling efficiency of the shaft bearing part (1*a*) of the supercharger (1) is high.

The oil supply pipe (3*a*) is disposed along the outer cylinder (5*a*) of the water-cooling-type oil cooler (5) and is fixed to the water-cooling-type oil cooler (5) with use of a clamp (60).

As illustrated in FIG. 1B, a circumferential wall of the inner cylinder (5*b*) of the water-cooling-type oil cooler (5) is constituted by folds that are bent inward and outward when viewed in a direction parallel with a central axis line (5*d*) of the inner cylinder (5*b*).

This makes a surface area of the inner cylinder (5*b*) that serves as a boundary of heat exchange wide, thereby making cooling efficiency of the engine oil (2) high.

The outer cylinder (5*a*) and the inner cylinder (5*b*) of the water-cooling-type oil cooler (5) are double cylinders that are concentric with each other, and the circumferential wall of the inner cylinder (5*b*) is bent inward toward the central axis line (5*d*) from positions located every predetermined angle in a circumferential direction.

Although contents of the embodiment of the present invention have been described above, the present invention is not limited to this embodiment.

For example, although the oil cooling device (24) uses a single water-cooling-type oil cooler (5) as a heat exchanger in this embodiment, the oil cooling device (24) may include, as a heat exchanger, another water-cooling-type oil cooler or an air-cooling-type oil cooler that cools the engine oil (2) supplied from the oil pump (36) to the oil gallery (38). In this case, energy consumption and a size of the other oil cooler are reduced due to the water-cooling-type oil cooler (5). In a case where the other oil cooler is disposed between the oil filter (37) and the front cover (17), an amount of protrusion of the oil filter (37) from the front cover (17) becomes small because of the reduced thickness of the other oil cooler.

What is claimed is:

1. An engine equipped with a supercharger, comprising:

a supercharger;

an oil supply passage that supplies engine oil to a shaft bearing part of the supercharger;

an oil discharge passage that discharges the engine oil from the shaft bearing part of the supercharger;

a radiator configured to release heat from engine cooling water circulating therethrough;

a water-cooling-type oil cooler provided in the oil discharge passage and having an outer cylinder and an inner cylinder and a cooler jacket between the inner cylinder and the outer cylinder;

an engine cooling fan generating engine cooling air; and an air path for the engine cooling air, wherein:

the engine oil discharged from the shaft bearing part of the supercharger travels through the inner cylinder and the engine cooling water travels through the cooler jacket, whereby heat of the engine oil in the inner cylinder is released to the engine cooling water in the cooler jacket through a peripheral wall of the inner cylinder, thereby cooling the engine oil, and the outer cylinder of the water-cooling-type oil cooler is made of a metal and is at least partially disposed in the air path, whereby an outer circumferential surface of the outer cylinder is exposed to the engine cooling air traveling through the air path, to, in turn, air cool the engine cooling water during passage through the cooler jacket, the engine cooling water subsequently being circulated to the radiator.

2. The engine equipped with a supercharger according to claim 1, further comprising an engine water-cooling device, wherein the engine water-cooling device includes the radiator, a cylinder jacket, and a cylinder head jacket, and the engine cooling water circulates in an order of the radiator, the cylinder jacket, and the cylinder head jacket, and the engine cooling water is supplied to the water-cooling-type oil cooler from the cylinder jacket.

3. The engine equipped with a supercharger according to claim 1, wherein the engine cooling water that passes through the water-cooling-type oil cooler is supplied to the water-cooling-type oil cooler on an upstream side in an oil passing direction that is a direction in which the engine oil passes through the water-cooling-type oil cooler and is discharged from the water-cooling-type oil cooler on a downstream side in the oil passing direction.

4. The engine equipped with a supercharger according to claim 1, wherein the water-cooling-type oil cooler includes a cooling-water introducing pipe for introducing the engine cooling water, the cooling-water introducing pipe is made of a metal, and an outer circumferential surface of the cooling-water introducing pipe is exposed to the engine cooling air in the air path.

5. The engine equipped with a supercharger according to claim 1, wherein the water-cooling-type oil cooler includes a cooling-water lead-out pipe for leading out the engine cooling water, the cooling-water lead-out pipe is made of a metal, and an outer circumferential surface of the cooling-water lead-out pipe is exposed to the engine cooling air in the air path.

6. The engine equipped with a supercharger according to claim 1, wherein the oil supply passage is constituted by an oil supply pipe made of a metal, and an outer circumferential surface of the oil supply passage is exposed to the engine cooling air in the air path.

7. The engine equipped with a supercharger according to claim 1, wherein a circumferential wall of the inner cylinder of the water-cooling-type oil cooler is constituted by folds that are bent inward and outward when viewed in a direction parallel with a central axis line of the inner cylinder.

* * * * *